United States Patent [19]

Heiman

[11] Patent Number: 4,685,675

[45] Date of Patent: Aug. 11, 1987

[54] ADJUSTABLY WEIGHTED RACQUET

[76] Inventor: Melvin Heiman, 2500 Parkview Dr., Hallandale, Fla. 33009

[21] Appl. No.: 809,243

[22] Filed: Dec. 16, 1985

[51] Int. Cl.[4] ..... A63B 49/04

[52] U.S. Cl. ..... 273/73 C

[58] Field of Search ..... 273/73 C, 73 D, 73 R, 273/73 H, 73 F, 73 K, 73 E, 73 G

[56] References Cited

U.S. PATENT DOCUMENTS 3,642,283 2/1972 Wilkens ..... 273/73 C 4,204,681 5/1980 Hall, Jr. et al. ..... 273/73 C

FOREIGN PATENT DOCUMENTS 1278474 6/1972 United Kingdom ..... 273/73 D

*Primary Examiner*—Richard C. Pinkham

*Assistant Examiner*—Matthew L. Schneider

*Attorney, Agent, or Firm*—Herbert L. Lerner; Laurence A. Greenberg

[57] ABSTRACT

An adjustably weighted racquet includes a head having a frame with multiplicity of holes distributed throughout the frame for receiving strings. The frame has a plurality of bores distributed throughout the frame, each of which are spaced from the holes. A plurality of individual weights are each insertible in a respective one of the bores and are movable from bore to bore for weighting the racquet as desired. A device such as E-rings or spring-loaded ball bearings is also provided for detachably locking the weights in the bores.

9 Claims, 8 Drawing Figures

ADJUSTABLY WEIGHTED RACQUET

The invention relates to an adjustably weighted racquet such as a tennis or racquet ball racquet.

Tennis racquets in particular are produced by manufacturers in extra light, light, light medium, medium and heavy weights to be sold in sporting goods stores or pro shops, etc.. However, buyers are reluctant to stock all five sizes, especially the medium and heavier weight racquets, because proportionately few players use medium or heavy racquets. For example, if racquets from five manufacturers are stocked, this would require five different sizes each of five different styles for a total inventory of 25 racquets. It therefore becomes difficult to find a heavy or medium racquet in a store. Furthermore, there is a demand for racquets in weights between the standard light and medium and between the standard medium and heavy weights. Additionally, it may be desirable to change or redistribute the weight of a racquet after it is purchased.

U.S. Pat. Nos. 4,427,195 and 4,142,721 disclose tennis racquets with a variable weight but the weight is disposed at the handle of the racquet instead of at the head which is the portion that strikes the ball and therefore should be weighted.

U.S. Pat. No. 4,200,285 relates to an exercise and training racquet having weights which are clamped around the frame. The racquet is not suitable for play since a ball will often hit the frame of the racquet during play and a true bounce off the frame would not be experienced if the ball hit such a clamped-on weight.

U.S. Pat. No. 4,353,551 discloses a tennis racquet wherein housings 8 are inserted in one surface of the frame of the head of the racquet in a direction facing the opposite surface of the racquet. Cylinders 10 are connected to a plate 12 by springs 11 and are disposed in the housings 8. The plate 12 is exposed at the face of the racquet so that an untrue bounce could also be expected if the plate was struck by a ball. The weights are dynamic weights which bounce back and forth toward and away from the plate 12 as the racquet is swung. Three housings 8 are exclusively disposed at one location on each side of the racquet. The weights 10 can only be disposed in the housings 8 and there is no way that the weight could be distributed by moving a weight from one location in the frame to another. According to another embodiment of the device, weights 6 are disposed in straps 7 looped around the outside of the frame, so that this embodiment cannot be used for actual play but only for practice because of the way it would affect the bounce of a ball.

Furthermore, the weights are only used to provide oscillating vibrations in order to damp vibrations caused by the ball hitting the racquet. They are not used to vary the actual weight of the racquet.

A racquet given the designation XAM-6 marketed by the firm Yamaha appeared in Tennis Industry Magazine Volume 13, No. 5 in May 1985. This racquet has weights or grommets which can be placed at different locations around the frame of the racquet. However, the strings of the racquet pass directly through the weights so that the only way to change the distribution or amount of weighting is to completely unstring and restring the racquet. This makes the weight of the racquet impossible to vary by the user. Additionally, the weights are not flush with the outside of the racquet.

It is accordingly an object of the invention to provide an adjustably weighted tennis racquet which overcomes the hereinafore-mentioned disadvantages of the heretofore-known devices of this general type and which permits variation in distribution and weighting by the user.

With the foregoing and other objects in view, there is provided, in accordance with the invention, an adjustably weighted racquet, comprising an adjustably weighted racquet, comprising a head having a frame, the frame having a multiplicity of holes distributed throughout the frame for receiving string, the frame having a plurality of bores distributed throughout the frame, each of the bores being spaced from the holes, a plurality of individual weights each being insertible in a respective one of the bores and being movable from bore to bore for weighting the racquet as desired, and means for detachably locking the weights in the bores.

The user of the racquet according to the invention can easily change the weight of the racquet or the distribution of the weights without restringing.

In accordance with another feature of the invention, the bores extend through the frame and the locking means are in the form of a neck formed on one end of each of the weights and E-rings each being snappable on one of the necks.

In accordance with a further feature of the invention, the bores extend through the frame, the frame has recesses formed therein each being coaxial with a respective one of the bores, and the locking means are in the form of spring-loaded ball bearings disposed in one end of each of the weights, the ball bearings being snappable in the recesses when the weights are inserted in the bores.

Both of these locking means are easily operated by the user.

In accordance with an added feature of the invention, the frame has an outer surface, and the weights are flush with the outer surface when inserted in the bores.

Since the weights are flush with the outer surface of the frame, they will not affect the bounce of a ball striking the region where the weight is located.

In accordance with again another feature of the invention, the outer surface of the frame has recesses formed therein each being coaxial with a respective one of the bores, and each of the weights has a head formed thereon matched to and disposed in one of the recesses.

In accordance with again an added feature of the invention, the heads are non-circular for preventing the weights from rotating.

In accordance with a concomitant feature of the invention, there are provided means for preventing the weights from rotating in the bores.

It is important to prevent rotation because any movement of the weights causes vibration when swinging the racquet and hitting a ball.

Other features which are considered as characteristic for the invention are set forth in the appended claims.

Although the invention is illustrated and described herein as embodied in an adjustably weighted racquet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figures 1, 2, 3, 4, 5, 6, 7, 8:
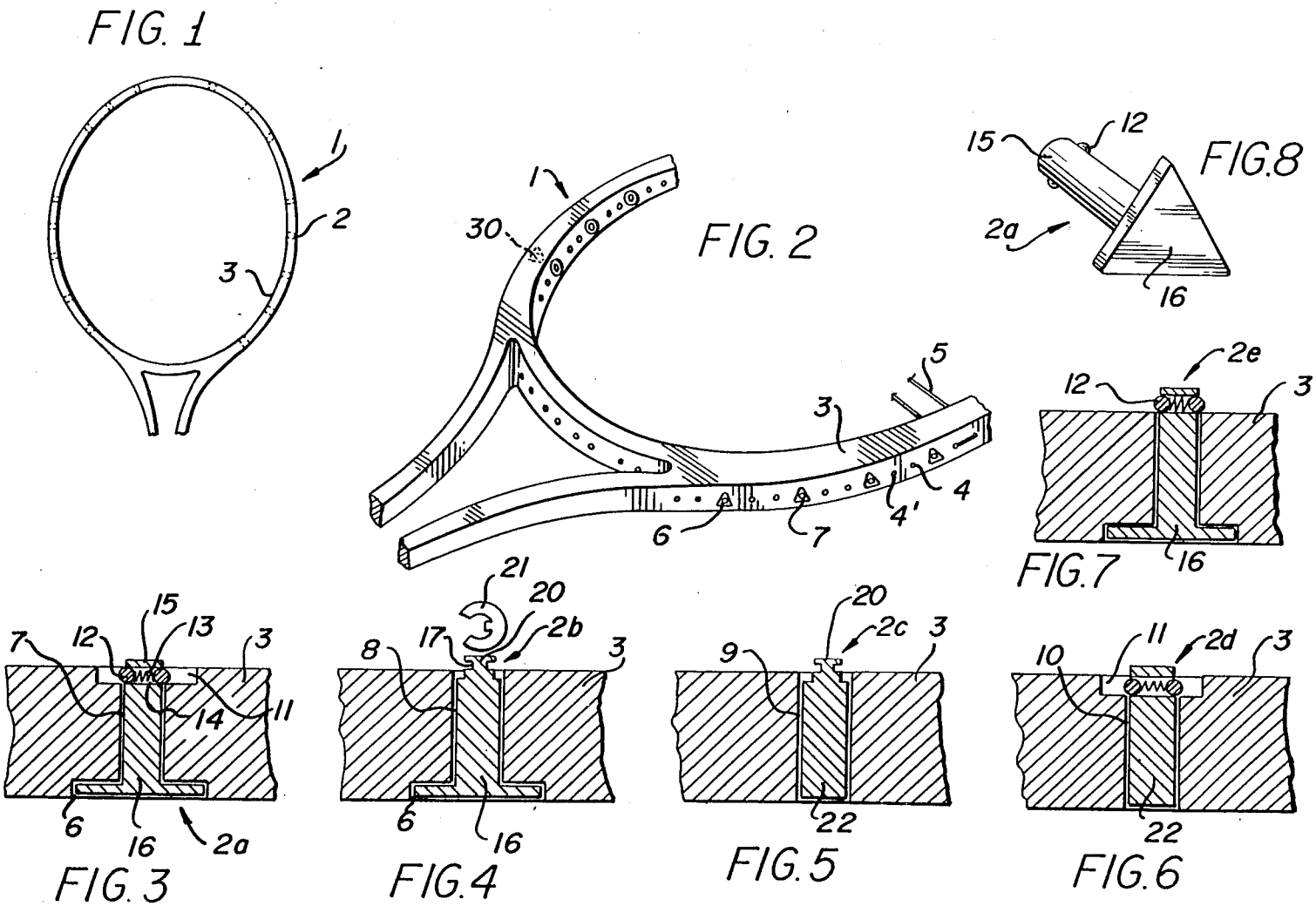
FIG. 1 is a fragmentary, diagrammatic, front-elevational view of a tennis racquet according to the invention.
FIG. 2 is a fragmentary prospective view of a portion of the tennis racquet of FIG. 1, on an enlarged scale.
FIGS. 3–7 are fragmentary, cross sectional views each showing a portion of the head of the tennis racquet with a weight according to four different embodiments of the invention on an even further enlarged scale.
FIG. 8 is a perspective view of the weight of the embodiment of FIG. 3.

Referring now to the figures of the drawing in detail and first, particularly, to FIG. 1 thereof, there is seen a head 1 of a tennis racquet having sixteen weights 2 shown in phantom in the frame thereof. The sixteen weights (which may be varied in number more or less by the manufacturer) are distributed throughout the frame 3 so as to be symmetrical with respect to a horizontal or vertical center line. Specifically, the upper portion of the frame 3 has six weights, the lower right portion has five weights and the lower left portion has five weights. However, the weights can be evenly distributed or grouped in any desired fashion.

FIG. 2 shows the frame 3 with the weights removed. The frame has conventional holes 4, 4′ distributed in pairs throughout. Strings 5 are looped through each pair of holes over the entire tennis racquet. The stringing of the racquet is conventional and therefore has not been shown in detail.

Between each two groups of holes is a cylindrical bore 7 passing completely through the frame 3. The bore 7 has a triangular recess 6 at the end of the bore located at the outer surface of the frame. The bore 7 also has a circular recess 11 at the end thereof located at the inner surface of the frame.

It should be noted that the bore 7 can also be disposed vertically in the frame 3, as shown in phantom at reference numeral 30.

FIG. 3 shows a cross-section taken through the frame 3 at one of the bores 7. The triangular recess 6 and the circular recess 11 are shown. It is also seen that a weight 2*a* is disposed in the bore 7.

The weight 2*a* has a triangular head 16, as also shown in FIG. 8. The head 16 fits snuggly into the recess 6 so that the outer surface of the frame 3 remains flush. The inner end 15 of the weight 2*a* has a channel 14 formed horizontally therein. Two ball bearings 12 are disposed in the channel with a spring 13 therebetween. The outer openings of the channel 14 are smaller than the diameter of the ball bearings 12 so that the ball bearings cannot be pushed out of the channel by the spring 13.

The weight 2*a* is constructed by hollowing out the end 15 of the weight and drilling the channel 14 horizontally through the end 15, with a diameter which is smaller than the diameter of the ball bearings 12. Two ball bearings 12 and the spring 12 are inserted in the hollow end 15 of the weight 2*a* with the ball bearings partially protruding out of the channel 14 which keeps the ball bearings and spring in place. The end 15 is then plugged with plastic or solder in order to form the remainder of the channel 14.

When the weight 2*a* is out of the bore 7 it appears as shown in FIG. 8. When the weight is inserted into a bore 7 from the recess 6 toward the recess 11, the ball bearings 12 are pushed towards each other by the surface of the frame 3 at the bore 7 and they spring back away from each other after they reach the recess 11. With a slight amount of direct pressure on the end 15, the weight 2*a* will slide back out of the bore 7. The triangular head 16 keeps the weight from rotating. Obviously, any polygonal shape such as a square would accomplish the same results.

FIG. 4 shows another embodiment of the bore bearing reference numeral 8 and the weight bearing reference symbol 2*b*. The bore 8 has the triangular recess 6 but not the circular recess 11. Instead, an I-shaped head 20 is formed on the weight 2*b*. An E-ring 21 is snapped over the neck 17 of the head 20 in order to hold the weight in place.

In the FIG. 5 embodiment a weight 2*c* is shown having an end 22 that has no polygonal shape. Instead, the weight 2*c* is exactly fitted to the size of the bore 9 in the frame 3 when inserted from the outer surface of the frame. The weight 2*c* can even be slightly expanded so that the end 22 is slightly larger than the other end.

An E-ring 21 is used on the end 20 of the weight 2*c* as in FIG. 4.

The FIG. 6 embodiment shows a weight 2*d* having the snuggly fitted or slightly expanded end 22 as in FIG. 5 and the end 15 with the ball bearing fastener as in FIG. 3.

FIG. 7 illustrates another embodiment similar to FIG. 3 except that the weight 2*e* is longer than the weight 2*a* and the recess 11 is not provided. Therefore, the ball bearings are locked against the inner surface of the frame 3. In this way, the racquet is not lightened by providing the recesses 11.

A tennis racquet may be manufactured between extra light, and heavy weights. A light-weight racquet is normally $12\frac{1}{4}$ ounces, a medium-weight racquet is $13\frac{1}{4}$ ounces and a heavy-weight racquet is $14\frac{1}{4}$ ounces. Racquets may be made of wood, metal, composition or a combination of materials, such as graphite, boron and fiberglass. The weights 2 according to the invention preferably weigh $\frac{1}{8}$ ounce each and are made of brass so that they can have this weight with small dimensions. For example, the weights may have a diameter of 0.300 inches where they pass through the bores 7–10, the head 20 may have an outer diameter of 0.150 inches and the neck 17 may have a diameter of 0.125 inches.

In accordance with the invention, a store would only stock, and a manufacturer would only produce, light weight racquets. Since sixteen bores 7 are provided in the frame 3 as shown in FIG. 1, a light-weight tennis racquet may be increased to a heavyweight tennis racquet by inserting a $\frac{1}{8}$ ounce weight in each of the 16 bores. Any desirable weight in between can also be reached by simply using more or less weights The weights can also be distributed in any desired manner and can be easily moved by the user. Naturally, heavier or lighter weights made of aluminum or lead, for instance, can also be used.

It should also be understood that the weighting system of the invention is not limited to use in tennis racquets but may be used for other types of racquets, such as racquet ball, squash, or badminton racquets, or even for golf clubs.

I claim:

1. Adjustably weighted racquet, comprising a head having a frame, said frame having a given number of holes distributed throughout said frame sufficient for completely stringing the racquet, said frame having a plurality of bores distributed throughout said frame, each of said bores being spaced from said holes, means for varying the weight and weight distribution of the racquet after string have been inserted in all of said holes without disturbing the strings, said varying means being in the form of a plurality of individual weights each being insertible in a respective one of said bores and being individually movable from bore to bore without disturbing the strings for weighting the racquet as desired, and means for detachably locking said weights in said bores.

2. Adjustably weighted racquet according to claim 1, wherein said bores extend through said frame and said locking means are in the form of a neck formed on one end of each of said weights and E-rings each being snappable on one of said necks.

3. Adjustably weighted racquet according to claim 1, wherein said bores extend through said frame, said frame has recesses formed therein each being coaxial with a respective one of said bores, and said locking means are in the form of spring-loaded ball bearings disposed in one end of each of said weights, said ball bearings being snappable in said recesses when said weights are inserted in said bores.

4. Adjustably weighted racquet according to claim 1, wherein said frame has an outer surface, and said weights have heads with said outer surface when inserted in said bores.

5. Adjustably weighted rocket according to claim 4, wherein said outer surface of said frame has recesses formed therein each being coaxial with a respective one of said bores, and each of said weights has a head formed thereon matched to and disposed in one of said recesses.

6. Adjustably weighted racquet according to claim 4, wherein said heads are non-circular for preventing said weights from rotating.

7. Adjustably weighted racquet according to claim 1, including means for preventing said weights from rotating in said bores.

8. Adjustably weighted racquet according to claim 1, wherein said frame has front, back and lateral surfaces, and said holes and said bores are formed in said lateral surfaces.

9. Adjustably weighted racquet according to claim 1, wherein said bores are distributed substantially throughout said frame, and the number of said bores may exceed the number of said weights so that some of said bores may be unoccupied by said weights.

* * * * *